US009585471B2

(12) United States Patent
Beauregard et al.

(10) Patent No.: US 9,585,471 B2
(45) Date of Patent: Mar. 7, 2017

(54) AUXILIARY UNIT AND AUXILIARY CABINET CAPABLE OF DISPLACEMENT UNDER A COUNTERTOP

(71) Applicant: ZIRCA INC., St-Bruno, Québec (CA)

(72) Inventors: Jeff Beauregard, St-Bruno (CA); Jocelyne Beaulieu, Brossard (CA)

( * ) Notice: Subject to any disclaimer, the term of this patent is extended or adjusted under 35 U.S.C. 154(b) by 0 days.

(21) Appl. No.: 14/424,072

(22) PCT Filed: Dec. 23, 2013

(86) PCT No.: PCT/CA2013/001083

§ 371 (c)(1),
(2) Date: Feb. 26, 2015

(87) PCT Pub. No.: WO2014/100892

PCT Pub. Date: Jul. 3, 2014

(65) Prior Publication Data

US 2015/0296981 A1 Oct. 22, 2015

Related U.S. Application Data

(60) Provisional application No. 61/747,021, filed on Dec. 28, 2012.

(51) Int. Cl.

| | |
|---|---|
| ***A47B 95/00*** | (2006.01) |
| ***A47B 83/04*** | (2006.01) |
| ***A47B 46/00*** | (2006.01) |
| ***A47B 45/00*** | (2006.01) |
| ***A47B 37/00*** | (2006.01) |
| ***A47B 43/00*** | (2006.01) |
| ***A47B 96/18*** | (2006.01) |

(Continued)

(52) U.S. Cl.

CPC ..... *A47B 83/045* (2013.01); *A47B 37/00* (2013.01); *A47B 43/00* (2013.01); *A47B 45/00* (2013.01); *A47B 46/00* (2013.01); *A47B 96/18* (2013.01); *A47B 97/00* (2013.01); *A47B 77/02* (2013.01); *A47B 2200/0011* (2013.01); *A47B 2200/13* (2013.01)

(58) Field of Classification Search

CPC ..... A47B 46/00
USPC ..... 312/201, 249.8–249.13, 304
See application file for complete search history.

(56) References Cited

U.S. PATENT DOCUMENTS

| | | | | |
|---|---|---|---|---|
| 676,748 | A * | 6/1901 | Hargrave | 126/339 |
| 2,419,766 | A * | 4/1947 | Domash | 312/201 |
| 4,318,575 | A * | 3/1982 | Redlich | 312/249.9 |

(Continued)

FOREIGN PATENT DOCUMENTS

| | | |
|---|---|---|
| GB | 727243 A | 3/1955 |
| JP | H09201240 | 8/1997 |
| JP | 2008036055 | 2/2008 |

*Primary Examiner* — Matthew Ing
(74) *Attorney, Agent, or Firm* — Benoit & Cote

(57) ABSTRACT

The present document describes auxiliary cabinet capable of displacement within an opening defined above a ground surface, the auxiliary cabinet comprising: a base cabinet; and a slideable guilding portion on the base cabinet for guiding the base cabinet within the opening during the dispacement between an extended position and a retracted position; wherein when the base cabinet is in the extended position, it is at its frontmost position and when the base cabinet is in the retracted position, it is at its rearmost position, thereby providing a working space above the ground surface.

10 Claims, 5 Drawing Sheets

(51) Int. Cl.
*A47B 97/00* (2006.01)
*A47B 77/02* (2006.01)

(56) References Cited

U.S. PATENT DOCUMENTS 4,365,854 A * 12/1982 Waller ..... 312/249.9
4,974,912 A * 12/1990 Rask ..... E05D 15/58
312/110
7,673,952 B2 * 3/2010 Jeansonne et al. ..... 312/209

* cited by examiner

AUXILIARY UNIT AND AUXILIARY CABINET CAPABLE OF DISPLACEMENT UNDER A COUNTERTOP

CROSS-REFERENCE TO RELATED APPLICATIONS

This application claims priority of U.S. provisional patent application No. 61/747,021, filed on Dec. 28, 2012.

BACKGROUND (a) Field

The subject matter disclosed generally relates to cabinets and units. More particularly, the subject matter disclosed relates to cabinets and units adapted for providing facilitated use by, without limitation, a physically handicapped person (i.e., such as a person in a wheelchair), an elderly person, children and the like.

(b) Related Prior Art

There is currently a growing demand for remodeling conventional kitchen and bathroom cabinet units (i.e., as well as other units for garages, offices and the like) so as to be better suited for use by, without limitation, a physically handicapped person (i.e., such as a person in a wheelchair), an elderly person (i.e., an elderly person walking with a walking stick or an elderly person that need to sit often), children (i.e., children that need to step up on a step to practice operations in a kitchen or in a bathroom) and the like.

In a practical situation, any conventional kitchen and bathroom cabinet unit (i.e., as well as other units for garages, offices and the like) has a front wall perpendicularly extending downward from the front edge of the countertop, of the countertop carrying a sink or of a countertop carrying a surface cooking elements. The front wall, which usually takes the form of the door of a cabinet, poses no problem as long as it is used by persons without a physical handicap (i.e., such as a person in a wheelchair), by children that need to step up on a step near or under the countertop, by elderly people that need to sit near or under the countertop when preparing diner, or that need to come near or under the countertop with their walking stick or any other supporting device, and the like.

Indeed, the front wall of the cabinet acts as an obstacle for a physically handicapped person, an elderly person, a child, an injured person and the like who manages to do kitchen work (or other tasks in a kitchen, a bathroom and the like) himself or herself, for instance, on this countertop while sitting in a wheelchair, sitting on a chair, standing on a step and the like.

More specifically, for a physically handicapped person, the foremost portion of the wheelchair such as the footplates impede his or her access by coming into contact with cabinet unit, thereby preventing the person from accessing the countertop (i.e., from the sink or surface cooking elements). Almost the same occurs when the foremost portion of the step/chair of a child or the chair of an elderly person impedes his or her access by coming into contact with cabinet unit, thereby preventing the person from accessing the countertop.

It is therefore difficult for the physically handicapped person, who has limited elbowroom in the wheelchair, to reach the sink or surface cooking elements on the countertop even when he or she fully extends his/her arms.

Further, when the handicapped persons, (i.e., elderly and child) are required to reach the farthest portion on the countertop, the physically handicapped person (i.e., the elderly and child) is required to lift his or her waist or take unnatural and laborious postures and actions, which is not acceptable for most of handicapped persons in wheelchairs (i.e., elderly person and child).

On the other hand, many designers and technicians try to redesign kitchen and/or bathroom spaces (and other spaces such as garages, offices and the like) by avoiding including base cabinets under sinks or surface cooking elements (i.e., an oven plate). The redesign might be conventional for a physically handicapped person in a wheelchair for example. However, these kinds of redesigns of kitchen and bathroom spaces (and any other suitable space) are more than often not esthetic.

One of the prior art units may include a displaceable cabinet which can displace from a first position to a second position on wheels under the countertop. However, since this kind of cabinet is not attached to the unit, it might be hard for a child, an elderly person and/or a physically handicapped person to displace it easily.

There is therefore a need for improved auxiliary cabinets and units for providing practical and esthetic, without limitation, kitchen, bathroom, office, garage spaces, and the like, for physically handicapped person, elderly person, children, injured person and the like.

SUMMARY

According to an embodiment, there is provided an auxiliary cabinet capable of displacement within an opening defined above a ground surface, the auxiliary cabinet comprising: a base cabinet; and a slidable guiding portion on the base cabinet for guiding the base cabinet within the opening during the displacement between an extended position and a retracted position; wherein when the base cabinet is in the extended position, it is at its frontmost position and when the base cabinet is in the retracted position, it is at its rearmost position, thereby providing a working space above the ground surface.

According to another embodiment, the slidable guiding portion is on a top wall of the base cabinet for interfacing with a corresponding fixed guiding portion installed about the opening.

According to a further embodiment, the slidable guiding portion comprises a first slidable guiding portion and a second slidable guiding portion, distant from the first slidable guiding portion and parallel to the first slidable guiding portion for respectively interfacing with a first fixed guiding portion and a second fixed guiding portion installed about the opening.

According to yet another embodiment, the slidable guiding portion is on at least one side wall of the base cabinet for interfacing with at least one corresponding fixed guiding portion on one of: another base unit beside the base cabinet, a furniture beside the base cabinet, a wall and a base unit.

According to another embodiment, the base cabinet further comprises a door hinged to at least one of: a top wall, side walls and a bottom wall of the base cabinet.

According to a further embodiment, the base cabinet further comprises at least one of: a drawer, a shelf, a hook and a plurality of compartments.

According to yet another embodiment, a bottom wall of the base cabinet further comprises an interfacing portion for interfacing with the ground surface.

According to another embodiment, at least one of the bottom wall and the interfacing portion further comprises one of: wheels and a roller for facilitating displacement of the base cabinet under the countertop.

According to a further embodiment, the auxiliary cabinet may further comprise a motor and a switch electrically coupled to the motor for electrically controlling and displacing the base cabinet under the countertop during the displacement between the extended position and the retracted position.

According to another embodiment, there is provided an auxiliary unit comprising: a self-standing base unit for interfacing with a ground surface; an auxiliary cabinet capable of displacement within an opening above the ground surface and under the self-standing base unit, the auxiliary cabinet comprising: a base cabinet; and a slidable guiding portion installed on the base cabinet for guiding the base cabinet within the opening during the displacement between an extended position and a retracted position; wherein when the base cabinet is in the extended position, it is at its frontmost position and when the base cabinet is in the retracted position, it is at its rearmost position, thereby providing a working space above the ground surface.

According to a further embodiment, the slidable guiding portion is on a top wall of the base cabinet for interfacing with a corresponding fixed guiding portion installed about the opening.

According to yet another embodiment, the slidable guiding portion comprises a first slidable guiding portion and a second slidable guiding portion, distant from the first slidable guiding portion and parallel to the first slidable guiding portion for respectively interfacing with a first fixed guiding portion and a second fixed guiding portion installed about the opening.

According to another embodiment, the slidable guiding portion is on at least one side wall of the base cabinet for interfacing with at least one corresponding fixed guiding portion on one of: another base unit beside the base cabinet, a furniture beside the base cabinet, a wall and a base unit.

According to a further embodiment, the base cabinet further comprises a door hinged to at least one of: a top wall, side walls and a bottom wall of the base cabinet.

According to yet another embodiment, the base cabinet further comprises at least one of: a drawer, a shelf, a hook and a plurality of compartments.

According to another embodiment, a bottom wall of the base cabinet further comprises an interfacing portion for interfacing with the ground surface.

According to a further embodiment, at least one of the bottom wall and the interfacing portion further comprises one of: wheels and a roller for facilitating displacement of the base cabinet under the countertop.

According to yet another embodiment, the auxiliary cabinet may further comprise a motor and a switch electrically coupled to the motor for electrically controlling and displacing the base cabinet under the countertop during the displacement between the extended position and the retracted position.

The following term is defined below.

The term "countertop" is intended to mean a countertop which may include, without limitation, a countertop working surface, a countertop carrying a sink, a countertop carrying a surface cooking elements and the like.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
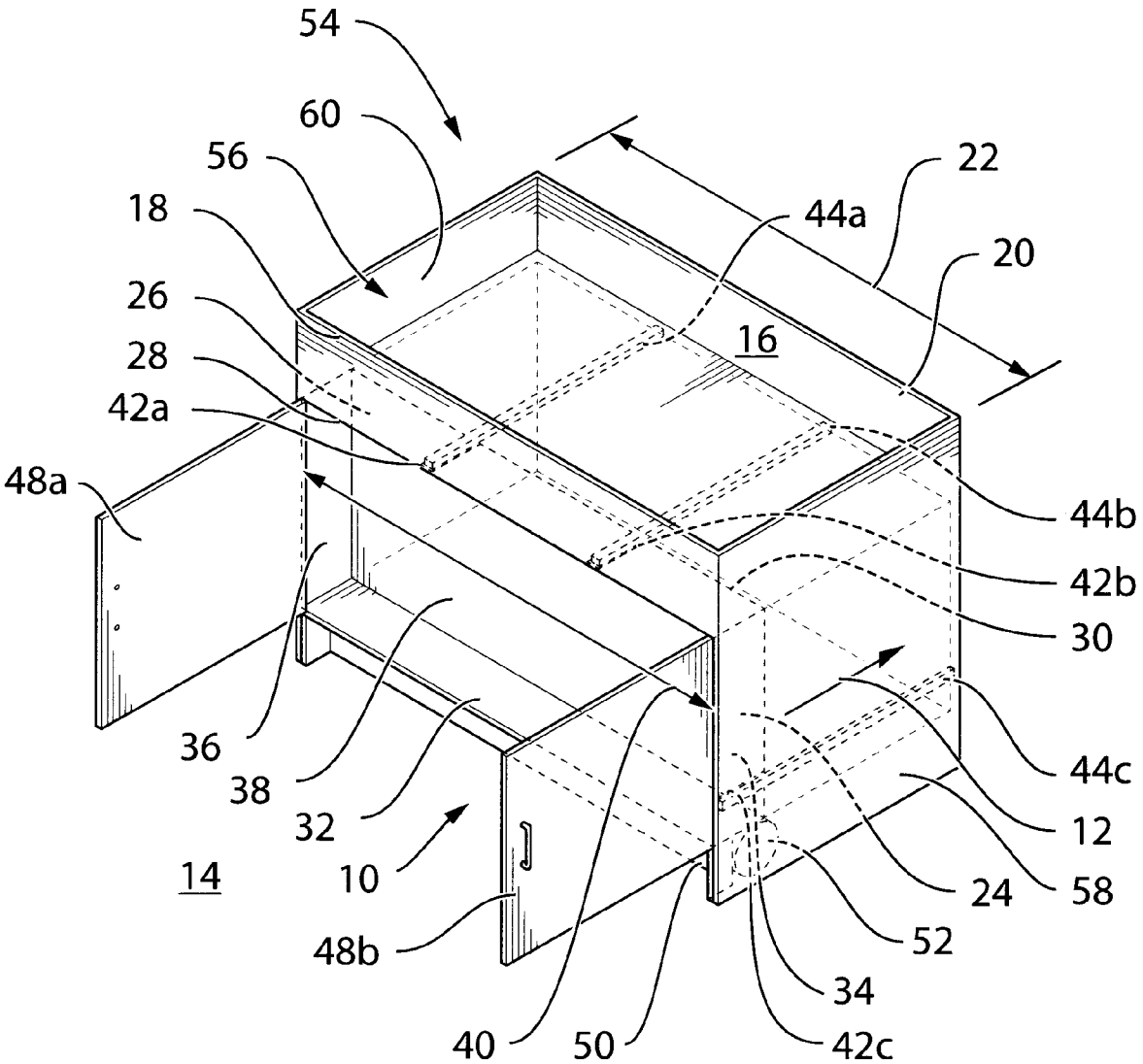
FIG. 1 is a perspective view of an auxiliary cabinet of an auxiliary unit in an extended position, showing the auxiliary cabinet having its doors in an opened position in accordance with an embodiment.

In embodiments there are disclosed auxiliary cabinets and auxiliary units. These auxiliary cabinets and auxiliary units may be installed in kitchens, bathrooms, garages, offices and any other suitable environment for receiving such auxiliary cabinets and auxiliary units.

Referring now to the drawings, and more particularly to FIGS. 1-4, there is shown an auxiliary unit 54. The auxiliary unit 54 includes a self standing base unit 56. The self standing base unit 56 has a countertop 16 which defines a front edge 18, a rear edge 20 and a self-standing base unit length 22. The self-standing base unit 56 also has side walls 58, 60 downwardly extending from the countertop 16 for interfacing with a ground surface 14. The auxiliary unit 54 further includes an auxiliary cabinet 10 capable of displacement (see arrow 12) above or on the ground surface 14 and within an opening 46 (and/or under the countertop 16).

Figure 2:
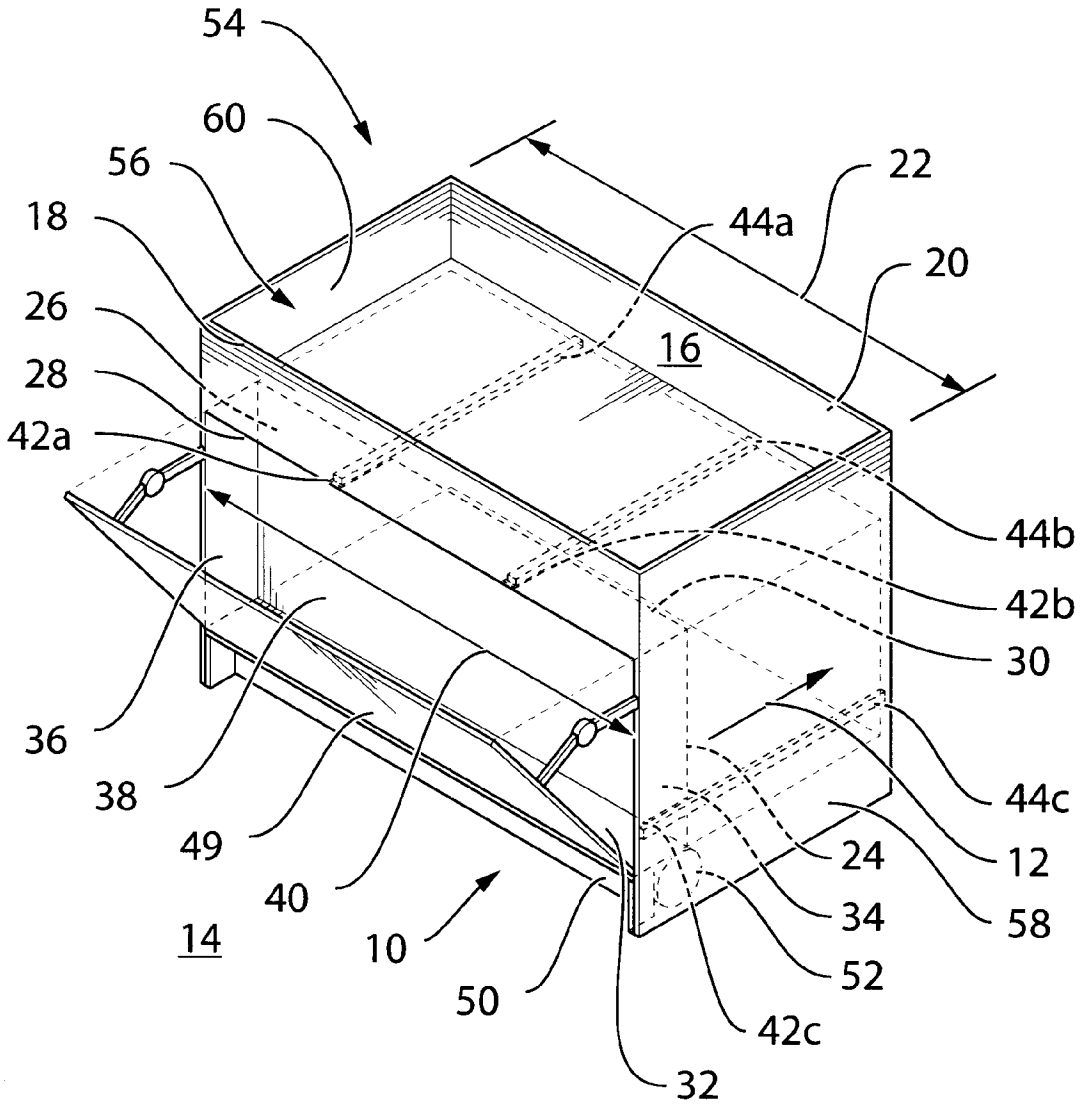
FIG. 2 is a perspective view of an auxiliary cabinet of an auxiliary unit in an extended position, showing the auxiliary cabinet having its doors in an opened position in accordance with another embodiment.
Figure 3:
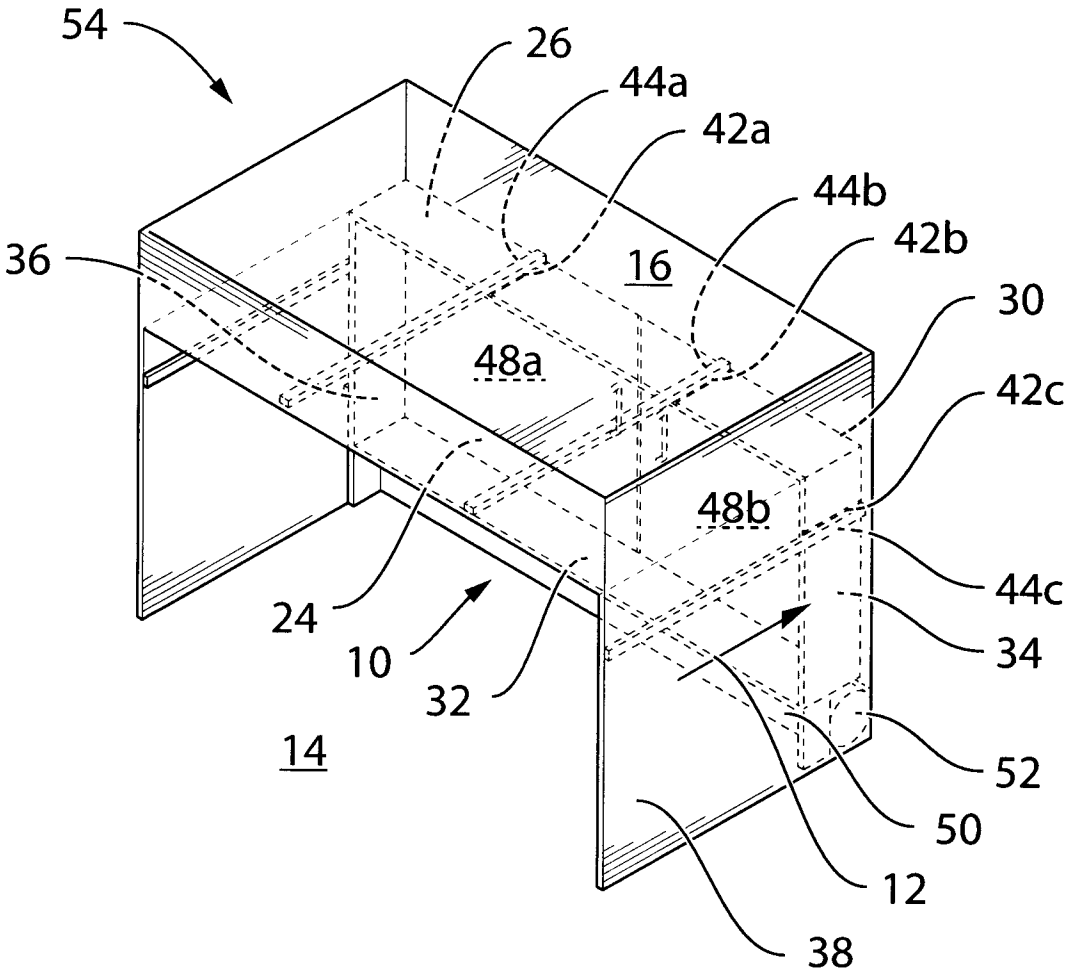
FIG. 3 is a perspective view of the auxiliary unit cabinet of the auxiliary unit of FIG. 1 in a retracted position, showing the auxiliary cabinet having its doors in a closed position.
Figure 4:
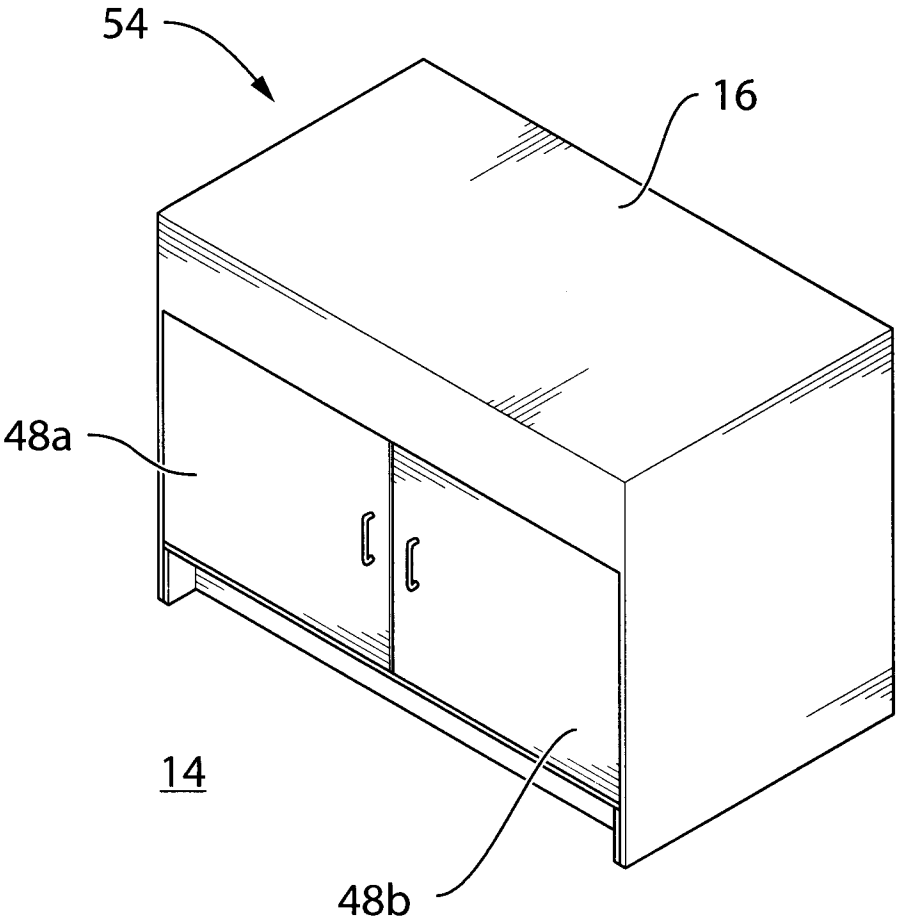
FIG. 4 is a perspective view of the auxiliary cabinet of the auxiliary unit of FIG. 1 in an extended position, showing the auxiliary cabinet having its doors in a closed position.

As shown in FIGS. 1 to 4, the auxiliary cabinet 10 includes a base cabinet 24 which has a top wall 26 which defines a front edge 28 and a rear edge 30, a bottom wall 32, side walls 34, 36 and a rear wall 38. The base cabinet 24 defines a base cabinet length 40 which is smaller than the self-standing base unit length 22 defined above. The auxiliary cabinet 10 also includes slidable guiding portions 42*a*, 42*b*, 42*c* on the top wall 26 of the base cabinet 24 and/or on the side walls 34, 36 of the base cabinet 24 for slidably interfacing with corresponding fixed guiding portions 44*a*, 44*b*, 44*c* on the self-standing base unit 56 for guiding and sliding the base cabinet 24 within the opening 46 during the displacement of the auxiliary cabinet 10 between an extended position (i.e., forward position of the auxiliary cabinet 10 within the auxiliary unit 54) (FIGS. 1, 2 and 4)

and an unextended position (i.e., rearward position of the auxiliary cabinet 10 within the auxiliary unit 54)(FIG. 4).

According to another embodiment (not shown), it is to be noted that the auxiliary cabinet 10 may include at least one slidable guiding portion such as slidable guiding portions 42*a*, 42*b* and/or 42*c* on the top wall 26, the bottom wall 32, the side walls 34 and/or 36 and/or the rear wall 38 of the base cabinet 24 for interfacing with at least one corresponding fixed guiding portion (i.e., such as mating connectors 44*a*, 44*b* and/or 44*c*) on the self-standing base unit 56 for guiding the base cabinet 24 under within the opening 56 during displacement of the auxiliary cabinet 10 between the extended or forward position (FIGS. 1, 2 and 4) and the retracted or rearward position (FIG. 3).

Still referring to FIGS. 1-2 and as described above, when the base cabinet 24 is in the extended position, it is at its frontmost position. As shown, the front edge 28 of the top wall 26 of the base cabinet 24 is substantially below and aligned with the front edge 18 of the countertop of the self standing base unit 56.

However, as shown in FIG. 3, when the base cabinet 24 is in the retracted position, it is at its rearmost position. In the rearmost position, the rear edge 30 of the top wall 26 of the base cabinet 24 is substantially near and aligned with the rear edge 20 of the countertop 16 of the self standing base unit 56. When the base cabinet 24 is in the retracted position, there is created a working space 46 (i.e., opening 56) between the ground surface and the countertop 16. The working space 46 is thus created between the side walls 58, 60 of the self standing base unit 56, the countertop 16, the ground surface 14 and the front edge 28 of the base cabinet 24. The created working space 46 helps a physically handicapped person (i.e., a person in a wheelchair), an elderly, a child, an injured person or a person that would need to sit in front of the countertop 16 (i.e., an elderly person, a child, an injured person and the like) to work closer to the countertop 16 when the base cabinet 24 is in the retracted position or rearmost position (FIG. 3) since there is working space 46 created to allow a wheelchair and/or the legs of a person (standing up or sitting down on a chair) to enter under the countertop 16. On the other hand, the extended position or frontmost position of the auxiliary cabinet 10 in the auxiliary unit 54 (FIGS. 1, 2 and 4) allows for an esthetic environment such as a kitchen environment, a bathroom environment, a garage environment, an office environment and/or any other working suitable environment that would require the creation of a working space such as working space 46. Alternatively, the created working space 46 may also provide a person (i.e., an elderly person, an injured person that wish to sit near the countertop 16 and/or a child on chair) to work closer to the countertop 16 sitting on a chair (not shown) when the base cabinet 24 is in the retracted position or rearmost position (FIG. 3) since there is a working space 46 created to allow the chair and the person knees and/or legs to enter under the countertop 16. On the other hand, the extended position or frontmost position (FIGS. 1, 2 and 4) still allows in this case for an esthetic environment such as a kitchen environment, a bathroom environment, a garage environment, an office environment and/or any other working suitable environment that would require the creation of a working space such as working space 46.

As shown in FIGS. 1-2, the slidable guiding portions 42*a*, 42*b* are installed on the top wall 26 of the base cabinet 24 for interfacing with the corresponding fixed guiding portions 44*a*, 44*b* installed about the opening 46. It is to be noted that any suitable slidable guiding portions and/or corresponding fixed guiding portions may be used for this application, as long as they allow the slidable displacement of the auxiliary cabinet 10 below the countertop 16 of the auxiliary unit 54 along displacement arrow 12.

As shown in FIGS. 1 and 2, the slidable guiding portion 42*a* on the top wall 26 of the base cabinet 24 is distant from the slidable guiding portion 42*b* and is parallel to it and the slidable guiding portions 42*a*, 42*b* are for respectively interfacing with the corresponding fixed guiding portions 44*a*, 44*b* about the opening 46, such as on the lower side of the countertop 16 which are also distant from and parallel to each other.

Still referring to FIGS. 1-2, there is shown that the slidable guiding portion 42*c* is on side wall 34 of the base cabinet 24 for interfacing with the corresponding fixed guiding portion 44*c* on side wall of self-standing base unit 56. Another side slidable guiding portion may be provided on the opposite side wall 36 of the base cabinet 24.

As shown in FIG. 3, the slidable guiding portions 42*a*, 42*b* and 42*c*, as well as the corresponding fixed guiding portions 44*a*, 44*b*, 44*c* are in their retracted position as the auxiliary cabinet 10 is.

Still referring to FIGS. 1-2, the base cabinet 24 further includes doors 48*a*, 48*b* (FIG. 1) or a door 49 (FIG. 2) hinged to at least one of: the top wall 26, the side walls 34, 36 and/or the bottom wall 32 of the base cabinet 24. FIG.1 shows that door 48*a* is hinged on side wall 36 and that door 48*b* is hinged on side wall 34 for covering the area of the base cabinet 24 exposed in the kitchen, the bathroom or any other environment. Any other suitable combinations of doors may be made for covering partially or totally the area of the base cabinet 24 exposed. It is further possible that the auxiliary cabinet 10 is doorless such as to show shelves (not shown) of the auxiliary cabinet 10 to the environment.

According to other embodiments, the base cabinet 24 may further include one or a plurality of drawers, shelves, hooks, compartments, any suitable combination and the like. Alternatively, the base cabinet 24 may simply include a structure without doors or a simple wall that extends and retracts between the extended position and the retracted position of the auxiliary unit 52.

As shown in FIGS. 1-2, the bottom wall 32 of the base cabinet 24 further includes an interfacing portion 50 for interfacing with the ground surface 14 and for covering the space created below the bottom wall 32 of the base cabinet 24. The bottom wall 32 and/or the interfacing portion 50 further include wheels 52 (or roller/rollers) for facilitating displacement of the base cabinet 24 under the countertop, but mostly for facilitating the displacement of the base cabinet 24 on the ground surface 14.

It is also to be noted that the self-standing base unit 56 may further include a door or doors (such as doors 48*a*, 48*b* of FIG. 1 and door 49 of FIG. 2) hinged to at least one of the countertop 16 and the side walls 58, 60 of the self-standing base unit 56. The self-standing base unit 56 may also include, without limitation, at least one of a drawer, a shelf, a hook, a plurality of compartments, any other suitable combination and the like.

It is also to be noted that the auxiliary cabinet 10 may be used or installed without the need for installing the self standing base unit 56. In this case, the slidable guiding portions 42*a*, 42*b*, 42*c* or other suitable slidable guiding portions may be installed on side walls and/or on top wall of the base cabinet 24 for interfacing with corresponding fixed guiding portions on one of: another base unit beside the base cabinet, a furniture (i.e., a bath, a refrigerator, and the like) beside the base cabinet 24, a wall beside the base cabinet 24 and the like.

Figure 5:
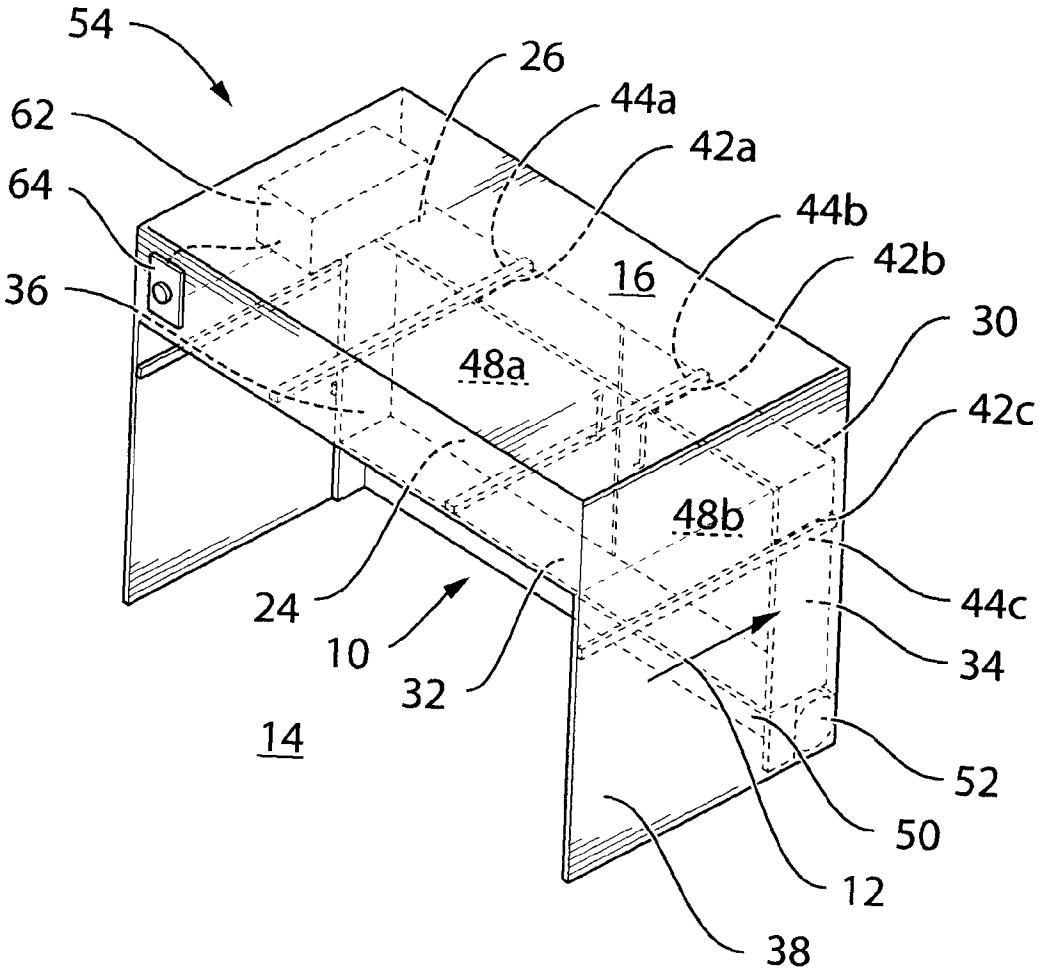
FIG. 5 is a perspective view of a motorized auxiliary unit cabinet of an auxiliary unit in accordance with another embodiment, in a retracted position, showing the auxiliary cabinet having its doors in a closed position.

According to another embodiment and referring now to FIG. 5, the auxiliary cabinet 10 may be motorized and capable of displacement (see arrow 12) above the ground surface 14 and within the opening 46, such as under the countertop 16 when driven by a motor 62. As shown, the motor 62 (i.e., a motor 62 which includes a controller (not shown)) may be installed within the auxiliary unit 54, below the countertop 16 and above the top wall 26 of the base cabinet 24. The auxiliary unit 54 may further include a switch 64 (i.e., such as a push button) electrically coupled to the motor 64 for controlling and displacing the auxiliary cabinet 10 within its auxiliary unit 10. A motorized auxiliary cabinet 10 may be more easily operated by a physically handicapped person, elderly person, injured person and the like. It is to be noted that a gearing element (not shown) may be provided between the motor 62 and the base cabinet 24, about the opening 46. For example, the gearing element may include a worm drive for displacing the base cabinet 24 between the extended position and the retracted position.

According to one embodiment, the switch may be replaced by an interface (not shown) (i.e., such as a wireless interface) which allows to control the auxiliary unit 10 when at a distance from it.

According to another embodiment, the auxiliary cabinet 10 including the base cabinet 24 may be about ⅛ the total weight of a conventional kitchen or bathroom base cabinet for allowing performance while in displacement.

The auxiliary unit 10 and the auxiliary cabinet 54 as described above present improved auxiliary cabinets and units for providing practical and esthetic, without limitation, kitchen environment, bathroom environment, office environment, garage environment, and the like, for physically handicapped person, elderly person, children, injured person and the like.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An auxiliary unit comprising:

a self-standing base unit for interfacing with a ground surface, the self-standing base unit having a front edge and comprising a left side wall, a right side wall and a top wall defining, with the ground surface an opening to a three-dimensional space which is substantially closed off on at least four sides, namely a bottom side closed off by the ground surface, a top side closed off by a top wall, a right side closed off by the right wall and a left side closed off by the left wall, the opening being at a front side of the three-dimensional space, the self-standing base unit further comprising a fixed guiding portion installed at least on the top wall and extending from the front edge of the self-standing base unit toward the rear thereof;

an auxiliary cabinet capable of displacement within the three-dimensional space above the ground surface, the auxiliary cabinet comprising:

a base cabinet having a front edge and a rear edge, wherein the distance between the front edge and the rear edge defines a depth of the base cabinet; and a slidable guiding portion installed on the base cabinet and interfacing with the fixed guiding portion for guiding the base cabinet within the opening during the displacement between an extended position and a retracted position;

wherein when the base cabinet is in the retracted position, it is at its rearmost position, thereby providing a working space having a depth within the opening above the ground surface, the depth of the working space being greater than the depth of the base cabinet, and when the base cabinet is in the extended position, it is at its frontmost position and the base cabinet substantially closes the opening.

2. The auxiliary unit of claim 1, wherein the slidable guiding portion is on a top wall of the base cabinet for interfacing with a corresponding fixed guiding portion installed about the opening.

3. The auxiliary unit of claim 2, wherein the slidable guiding portion comprises a first slidable guiding portion and a second slidable guiding portion, distant from the first slidable guiding portion and parallel to the first slidable guiding portion for respectively interfacing with a first fixed guiding portion and a second fixed guiding portion installed about the opening.

4. The auxiliary unit of claim 1, wherein the base cabinet further comprises a door hinged to at least one of: a top wall, side walls and a bottom wall of the base cabinet.

5. The auxiliary unit of claim 4, wherein the base cabinet further comprises at least one of: a drawer, a shelf, a hook and a plurality of compartments.

6. The auxiliary unit of claim 1, wherein a bottom wall of the base cabinet further comprises an interfacing portion for interfacing with the ground surface.

7. The auxiliary unit of claim 6, wherein at least one of the bottom wall and the interfacing portion further comprises one of: wheels and a roller for facilitating displacement of the base cabinet under the top wall.

8. The auxiliary unit of claim 1, further comprising a motor and a switch electrically coupled to the motor for electrically controlling and displacing the base cabinet under the top wall during the displacement between the extended position and the retracted position, wherein the motor is installed above the top wall.

9. The auxiliary unit of claim 1, wherein the slidable guiding portion is on at least one side wall of the base cabinet for interfacing with a corresponding fixed guiding portion installed about the opening.

10. The auxiliary unit of claim 9, wherein the self-standing base unit comprise a side wall, and the corresponding fixed guiding portion is mounted on the side wall.

* * * * *